US006114678A

United States Patent [19]

Lee

[11] Patent Number: 6,114,678

[45] Date of Patent: Sep. 5, 2000

[54] MICROWAVE OVEN ABNORMAL STATE DETECTING DEVICE AND METHOD OF DETECTING ABNORMAL STATE OF MICROWAVE OVEN

[75] Inventor: Won-Woo Lee, Ansan, Rep. of Korea

[73] Assignee: Samsung Electronics Co., Ltd., Suwon, Rep. of Korea

[21] Appl. No.: 09/257,528

[22] Filed: Feb. 25, 1999

[30] Foreign Application Priority Data

Jul. 29, 1998 [KR] Rep. of Korea ..... 98-30624

[51] Int. Cl.[7] ..... H05B 6/68

[52] U.S. Cl. ..... 219/716; 219/702; 219/761

[58] Field of Search ..... 219/715, 716, 219/718, 702, 761, 721

[56] References Cited

U.S. PATENT DOCUMENTS

| | | | |
|---|---|---|---|
| 4,900,989 | 2/1990 | Suenaga et al. | 315/224 |
| 5,274,208 | 12/1993 | Noda | 219/716 |
| 5,283,411 | 2/1994 | Sung-Wan | 219/719 |
| 5,571,439 | 11/1996 | Daley | 219/716 |
| 5,575,943 | 11/1996 | Lee | 219/710 |

FOREIGN PATENT DOCUMENTS

| | | | |
|---|---|---|---|
| 3-62496 | 3/1991 | Japan | 219/716 |
| 2 246 917 | 2/1992 | United Kingdom | 219/716 |

*Primary Examiner*—Philip H. Leung

*Attorney, Agent, or Firm*—Burns, Doane, Swecker & Mathis, L.L.P.

[57] ABSTRACT

A device of detecting an abnormal state of a microwave oven having relays, a high voltage transformer, and a magnetron, including a voltage sensing part connected between the high voltage transformer and the magnetron to sense a voltage applied to the magnetron's both terminals; and a control part receiving the voltage between the magnetron's terminals from the voltage sensing part to determine an unloaded state where nothing is in a cooking chamber or an overheated state of the magnetron or the cooking chamber, and when determining that the oven is in the abnormal state, turning off the relays to stop the operation of the magnetron; and a method of detecting an abnormal state of a microwave oven including the steps of driving a magnetron to perform a user-selected cooking operation; detecting a voltage between the magnetron's both terminals; computing an average voltage by averaging the voltage between the magnetron's terminals; detecting an abnormal state by comparing the average voltage to a reference voltage; and if determining that the oven is in the abnormal state, stopping the operation of the magnetron.

10 Claims, 5 Drawing Sheets

MICROWAVE OVEN ABNORMAL STATE DETECTING DEVICE AND METHOD OF DETECTING ABNORMAL STATE OF MICROWAVE OVEN

BACKGROUND OF THE INVENTION (1) Field of the Invention

The present invention generally relates to a microwave oven abnormal state detecting device and a method of detecting an abnormal state of a microwave oven. More particularly, it relates to a microwave oven abnormal state detecting device that is capable of monitoring either an unloaded state of a cooking chamber or an overheating of a magnetron or a cooking chamber by the use of a voltage applied to both terminals of the magnetron, and further relates to a method of detecting an abnormal state of a microwave oven.

(2) Description of the Prior Art

An overheat cutoff switch such as a therm-switch has been generally employed in each of a magnetron and a cooking chamber of a microwave oven to provide protection to microwave oven components against overheating of the magnetron and cooking chamber.

There is U.S. Pat. No. 5,575,943 as a prior art relating to a safety mechanism for a microwave oven using this overheat cutoff switch. This '943 Patent discloses a safety mechanism that protects a microwave oven by detecting an overheating of a cooking chamber and a magnetron via a thermostat. According to this safety mechanism, the thermostat is installed on an appropriate position where it can easily sense the magnetron's ambient temperature and temperatures of the air out of the cooking chamber. If the magnetron's ambient temperature or the temperatures of the air out of the cooking chamber is higher than a predetermined allowable temperature, the power supply from the outside is cut off to provide protection to the microwave oven. FIG. 1 is a block diagram of a conventional microwave oven's abnormal state detecting device employing an overheat cutoff switch.

As shown in FIG. 1, the conventional microwave oven abnormal state detecting device includes a noise filter 2 that removes noise contained in an applied AC power 1; a key input part 5 which receives a key signal input by a user; a first relay RY11 that supplies or cuts off the applied AC power 1; a second relay RY12 that supplies or cuts off the power to a fan motor FM; a magnetron 4 that generates an electromagnetic wave of high frequencies to the cooking chamber; and a high voltage part 3 having a first coil to which the AC power 1 is applied, and a second coil connected to the magnetron 4.

The conventional microwave oven abnormal state detecting device also includes a first therm-switch T1 installed on one side of the bottom of the cooking chamber, and cutting off the applied AC power 1 if the cooking chamber's temperature is higher than a predetermined value; a second therm-switch T2 that is installed near the magnetron 4, and stops the operation of the magnetron 4 if the magnetron 4's temperature is higher than a predetermined value; and a control part 6 that opens or closes the first and second relays RY11 and RY12 to perform the cooking function selected through the key input part 5.

The high voltage part 3 consists of a high-voltage transformer (HVT) that increases the AC power 1 applied from the first coil to a given level at the second coil; a high-voltage fuse (HF) containing a section of conductor which melts when the increased AC power through it exceeds a rated value for a definite period of time; and a high voltage condenser (HVC) and a high voltage diode (HVD) that divide and rectify the AC power increased by the high voltage transformer (HVT) and apply it to the magnetron 4.

The following description concerns the operation of the conventional microwave oven.

If a user opens the microwave oven door and puts a foodstuff in the cooking chamber, and then selects one of various cooking functions by using the key input part 5, the control part 6 turns on the first and second relays RY11 and RY12 to apply the input AC power 1 to the high voltage part 3 and operate the fan motor (FM) in order to cook the foodstuff in the cooking chamber according to the user-input cooking command.

The magnetron 4 emits the electromagnetic wave of high frequencies to the interior of the cooking chamber, thus starting the cooking operation.

If the cooking chamber's temperature becomes higher than a predetermined value, i.e. the cooking chamber is overheated during cooking where the conventional microwave oven's magnetron 4 is operating, the first therm-switch T1 is turned off to shut off the power supply. In addition, if the magnetron 4's temperature becomes higher than a predetermined value during cooking, the second therm-switch T2 is turned off to stop the operation of the magnetron 4. A bimetal that is turned off automatically if the temperature becomes higher a rated value can be used as the therm-switches.

In the conventional microwave oven employing these therm-switches, once a user carelessly inputs a desired cooking command through the key input part in an unloaded state where nothing is in the cooking chamber, the control part does not sense it and operates the magnetron 4 in response to the applied signal. Accordingly, the electromagnetic wave of high frequencies is emitted to the interior of the cooking chamber that does not contain any foodstuff to be cooked, thus damaging the internal components of the microwave oven. In addition, if any one of the overheat cutoff switches, each provided to the cooking chamber and the magnetron, becomes degraded by long-time use, it is not turned off in a good time to cause various dangerous troubles.

In addition, the therm-switch serving as an overheat cutoff switch, must be provided to each of the cooking chamber and the magnetron, thus making the structure of the microwave oven complicated, and increasing the overall production costs.

SUMMARY OF THE INVENTION

Accordingly, the present invention is directed to a microwave oven abnormal state detecting device and a method of detecting an abnormal state of a microwave oven that substantially obviate the problems due to limitations and disadvantages of the related art.

It is an object of the present invention to provide a microwave oven abnormal state detecting device that is capable of monitoring an unloaded state of a cooking chamber or an overheating of a magnetron or a cooking chamber by the use of a voltage applied to both terminals of the magnetron without using any conventional overheat cutoff switch, and stops the operation of the magnetron when determining that the microwave oven is in the abnormal state, thereby preventing damage to the microwave oven, and to further provide a method of detecting such an abnormal state of the microwave oven.

In order to obtain the above-mentioned objectives of the present invention, there is disclosed a device of detecting an abnormal state of a microwave oven having relays either applying or cutting off a power, a high voltage transformer receiving a voltage through the relays and increasing the voltage to a given level, and a magnetron driven by the voltage increased by the high voltage transformer and generating a high frequency to a cooking chamber, the device including a voltage sensing part connected between the high voltage transformer and the magnetron to sense a voltage applied to both terminals of the magnetron; and a control part receiving the voltage between both the terminals of the magnetron from the voltage sensing part to determine an unloaded state where nothing is in the cooking chamber or an overheated state of the magnetron or the cooking chamber, and when determining that the microwave oven is in the abnormal state, turning off the relays to stop the operation of the magnetron.

According to another aspect of the present invention, a method of detecting an abnormal state of a microwave oven includes the steps of driving a magnetron to perform a user-selected cooking operation; detecting a voltage between both terminals of the magnetron; computing an average voltage by averaging the voltage applied to both the terminals of the magnetron; detecting an abnormal state by comparing the average voltage to a given reference voltage; and if the microwave oven is in the abnormal state, stopping the operation of the magnetron.

According to still another aspect of the present invention, a method of detecting an abnormal state of a microwave oven includes the steps of driving a magnetron to perform a user-selected cooking operation; detecting a voltage between both terminals of the magnetron; converting the voltage between both the terminals of the magnetron to a digital signal; computing an average voltage by averaging the voltage applied to both the terminals of the magnetron; determining if the average voltage of the voltage applied to both the terminals of the magnetron is lower than the reference voltage; and if the average voltage is lower than the reference voltage, determining that the microwave oven is in an abnormal state, and stopping the operation of the magnetron.

DETAILED DESCRIPTION OF THE PREFERRED EMBODIMENTS

Reference will now be made in detail to the preferred embodiments of the present invention, examples of which are illustrated in the accompanying drawings.

Figure 1:
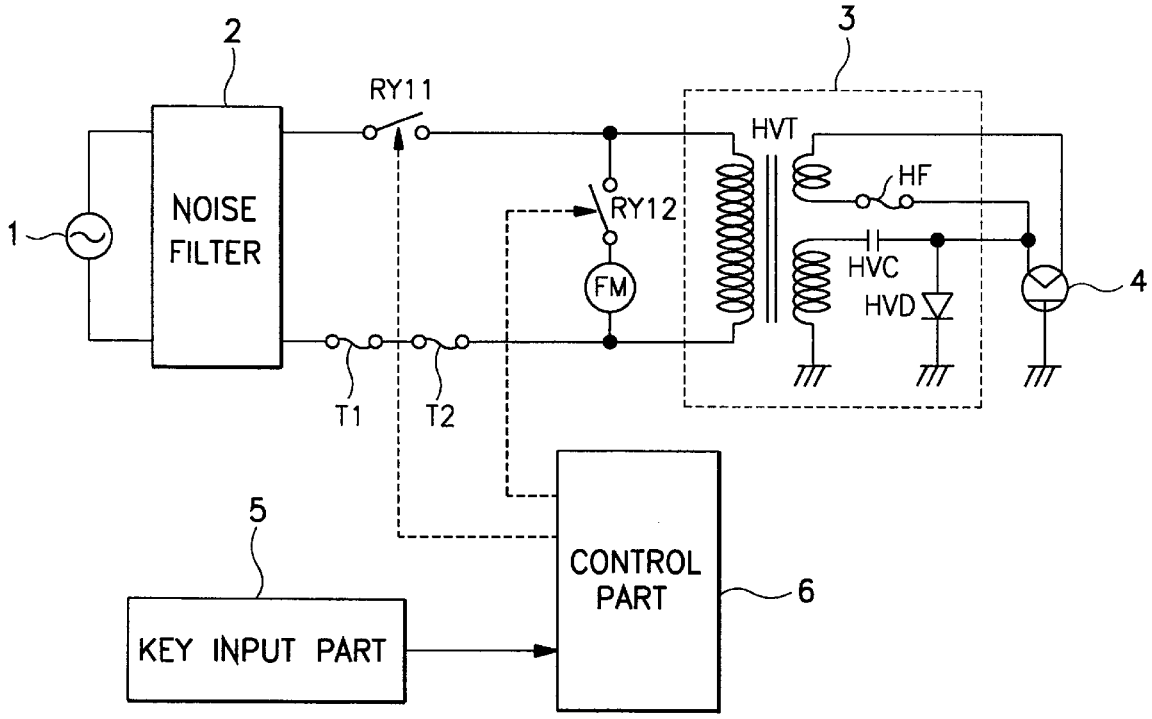
FIG. 1 (Prior Art)
FIG. 1 is a block diagram of a conventional microwave oven abnormal state detecting device using an overheat cutoff switch.
Figure 2:
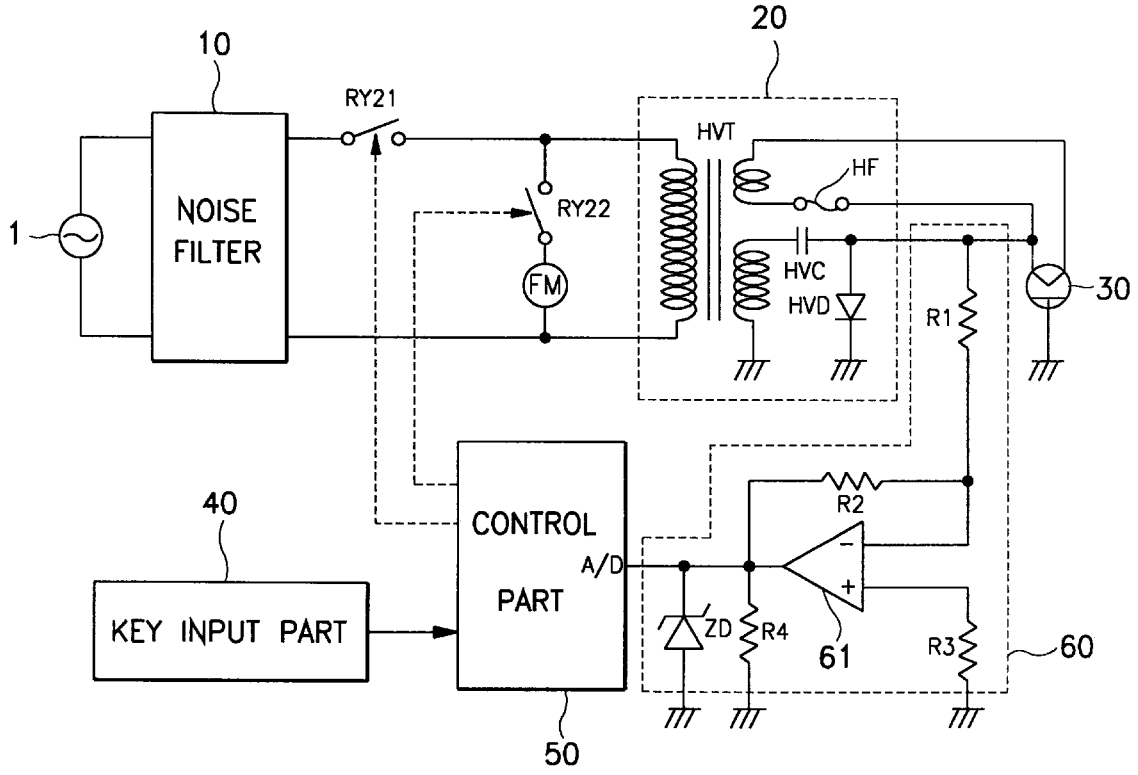
FIG. 2 is a block diagram of a microwave oven abnormal state detecting device without any conventional overheat cutoff switch in accordance with the present invention.

FIG. 2 is a block diagram of a microwave oven abnormal state detecting device without any overheat cutoff switch in accordance with the present invention.

Referring to FIG. 2, a microwave oven abnormal state detecting device of the present invention includes a noise filter 10 that removes noise contained in an applied AC power 1; a key input part 40 which receives a key signal input by a user; a first relay RY21 that either supplies or cuts off the input AC power 1; a second relay RY22 that either supplies or cuts off the power to a fan motor FM; a magnetron 30 that generates an electromagnetic wave of high frequencies to a cooking chamber; and a high voltage part 20 having a first coil to which the applied AC power 1 is applied, and a second coil connected to the magnetron 30 to thereby drive the magnetron 30.

The microwave oven abnormal state detecting device also includes a voltage sensing part 60 connected between the high-voltage part 20 and the magnetron 30 to check a voltage Vap applied to the magnetron 30's both terminals; and a control part 50 that stops the magnetron 30 by turning off the first and second relays RY21 and RY22 if the voltage between both the terminals of the magnetron 30 checked by the voltage sensing part 60 are higher than a predetermined reference voltage.

The high voltage part 20 consists of a high-voltage transformer (HVT) that increases the AC power 1 applied from the first coil to a given level at the second coil; a high-voltage fuse (HF) containing a section of conductor which melts when the increased AC power through it exceeds a rated value for a definite period of time; and a high voltage condenser (HVC) and a high voltage diode (HVD) that divide and rectify the AC power increased by the high voltage transformer (HVT) and apply it to the magnetron 30.

The above voltage sensing part 60 includes a first resistor R1 and a second resistor R2 that are connected to a negative electrode of the magnetron 30 to reduce the high voltage part 20's output voltage to a given level; a comparator 61 that compares the voltages of the magnetron 30, decreased through the first and second resistors R1 and R2 and input to an inverting terminal (−), with a reference voltage applied to a non-inverting terminal (+) through a third resistor R3; and a fourth resistor R4 and zener diode ZD connected to an output terminal of the comparator 61.

The following description relates to the operation of the inventive microwave oven abnormal state detecting device and its advantage that can be obtained.

Figure 3A:
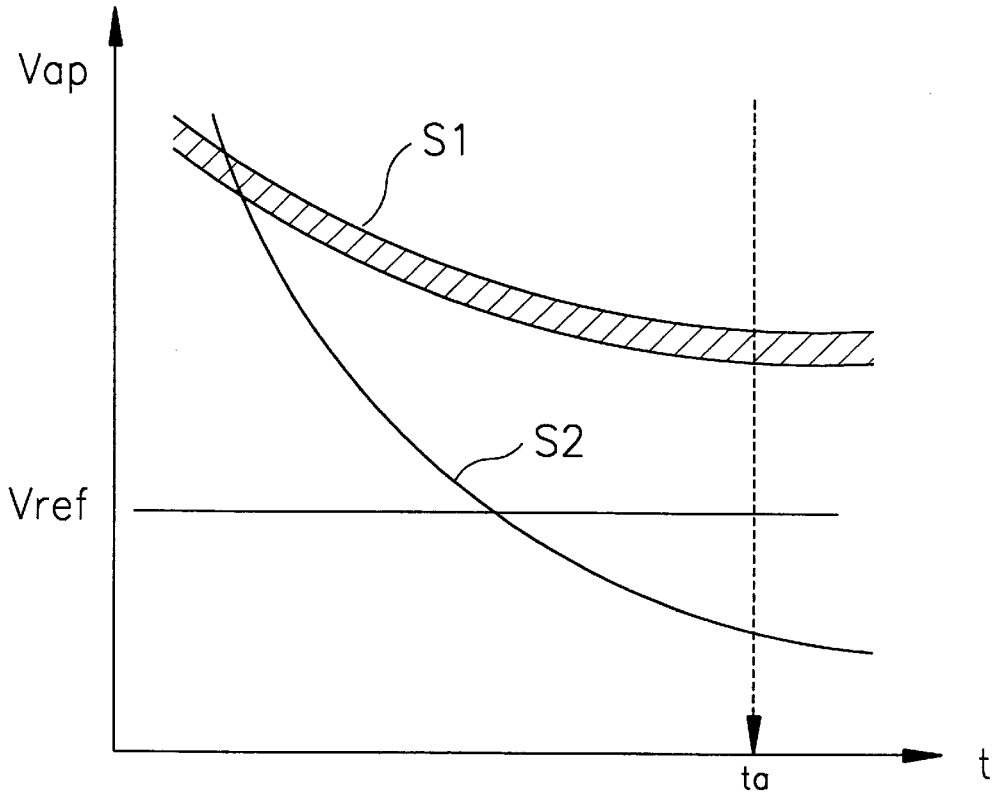
FIG. 3A graphically depicts a voltage (Vap) applied to both terminals of a magnetron that varies with the existence of a foodstuff (i.e. load) to be cooked in the microwave oven's cooking chamber.

FIG. 3A graphically depicts a voltage (Vap) applied to both the terminals of the magnetron 30 that varies with the existence of a foodstuff (i.e. load) to be cooked in the microwave oven's cooking chamber.

Referring to FIG. 3A, when a user puts a foodstuff in the cooking chamber and operates the magnetron 30, the voltage between both the terminals of the magnetron 30 is slowly decreased with time as indicated by a first curve S1. Even after a given period of time ta elapses, the voltage Vap of the magnetron 30 is still higher than the reference voltage Vref. However, if the user does not put the foodstuff in the cooking chamber (i.e. the unloaded state), as the magnetron 30 is driven, the voltage Vap of the magnetron 30 is abruptly decreased with time, as indicated by a second curve S2, and becomes lower than the reference voltage Vref.

If the magnetron 30 is driven while nothing exists in the cooking chamber and the voltage Vap of the magnetron 30 is kept lower than the reference voltage Vref for a long period of time, the internal components are fatally damaged, and a fire may break out thereby.

Hence, if the voltage Vap of the magnetron 30 becomes lower than the reference voltage Vref in a given period of time ta, the control part 50 interprets it as an unloaded state where nothing is in the cooking chamber, and opens the relays to cut off the input AC power 1 so as to prevent the microwave oven from being damaged.

In addition, if the magnetron 30 is driven with a foodstuff to be cooked in the cooking chamber to overheat the cooking chamber, or if the temperature of the magnetron 30 becomes higher than a rated value, the voltage sensing part 60 determines that the voltage Vap of the magnetron 30 becomes lower than the reference voltage Vref. Therefore, the control part 50 can recognize such an overheated state from the voltage Vap of the magnetron 30, so cuts off the input AC power 1 immediately to protect the microwave oven's internal components from overheating.

The voltage sensing part 60 drops the AC voltage output from the high voltage part 20 in the ratio of the resistance of the first relay R1 connected to the negative electrode (−) of the magnetron 30 and that of the second relay R2 connected to the comparator 61's inverting terminal (−). The high voltage part 20 applies a rectified voltage of about 4 kV to the magnetron 30. The voltage sensing part 60 decreases the voltage of about 4 kV applied to the magnetron 30 through the first and second resistors R1 and R2 in order to compare that with the preset reference voltage Vref applied to the non-inverting terminal (+).

The resistance of each of the first resistor R1 and the second resistor R2 is properly set according to the voltage drop rate, and in this preferred embodiment of the present invention, since the high voltage part 20 applies the rectified voltage of about 4 kV to the magnetron 30, the resistance of the first resistor R1 and the second resistor R2's are set to 20 MΩ and 20 kΩ, respectively, to drop the voltage of 4 kV in the ratio of 1/1000.

The comparator 61 compares the voltage Vap of the magnetron dropped through the inverting terminal (−) to the reference voltage Vref applied across the non-inverting terminal (+), thus producing a signal indicative of a difference of the voltages to the control part 50. The zener diode ZD connected to the output terminal of the comparator 61 serves to prevent a backward voltage over the constant voltage.

The control part 50 recognizes the voltage Vap of the magnetron 30 upon receipt of the output signal of the comparator 61 through an internal analog/digital (A/D) converting terminal, and if the voltage Vap is lower than the reference voltage Vref, it interprets that as either an unloaded or overheated state of the cooking chamber, or an overheating of the magnetron 30, and then turns off the relays RY21 and RY22.

Figure 3B:
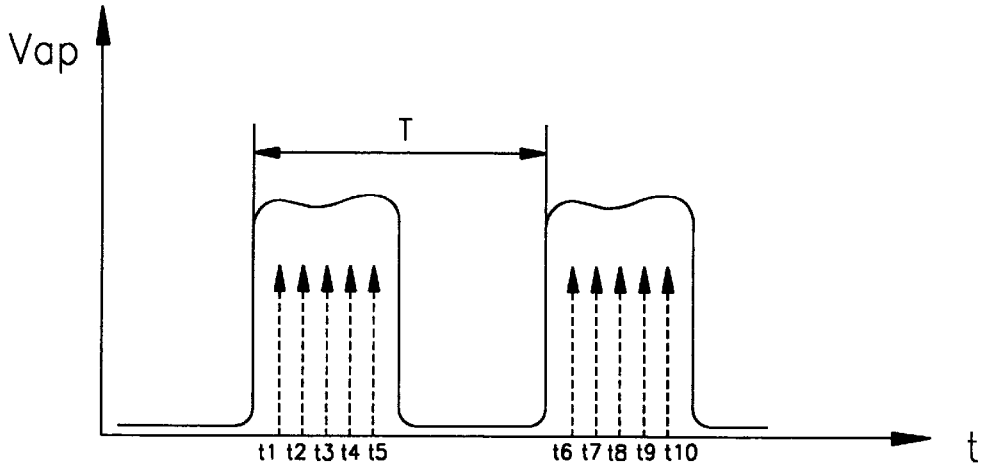
FIG. 3B graphically depicts a voltage (Vap) applied to the magnetron's both terminals produced as a pulse signal of given period and converted to a digital signal.

FIG. 3B graphically depicts the voltage Vap between the magnetron's both terminals input to the A/D converting terminal of the control part 50 and produced as a pulse signal of given period (T) corresponding to the magnetron 30's oscillating period.

As depicted in FIG. 3B, the control part 50 detects voltage values five times (t1 to t5) per period with respect to the output waveform of the voltage Vap of the magnetron 30. The control part 50 adds all of them and then divides a resultant by five to compute an average voltage. After that, the control part 50 determines whether or not the average voltage is lower than the reference voltage Vref, and if the number of the voltage values' being lower than the reference voltage is larger than a given number, it interprets that as an abnormal state of the microwave oven to turn off the relays RY21 and RY22.

As the relay RY21 is turned off, the input AC power 1 is cut off to stop the operation of the magnetron 30, thereby preventing damage to the microwave oven's internal components and various troubles that may occur by leaving the abnormal state unsettled for a long period of time.

The method of controlling the microwave oven abnormal state detecting device is now described with reference to FIG. 4.

Figure 4:
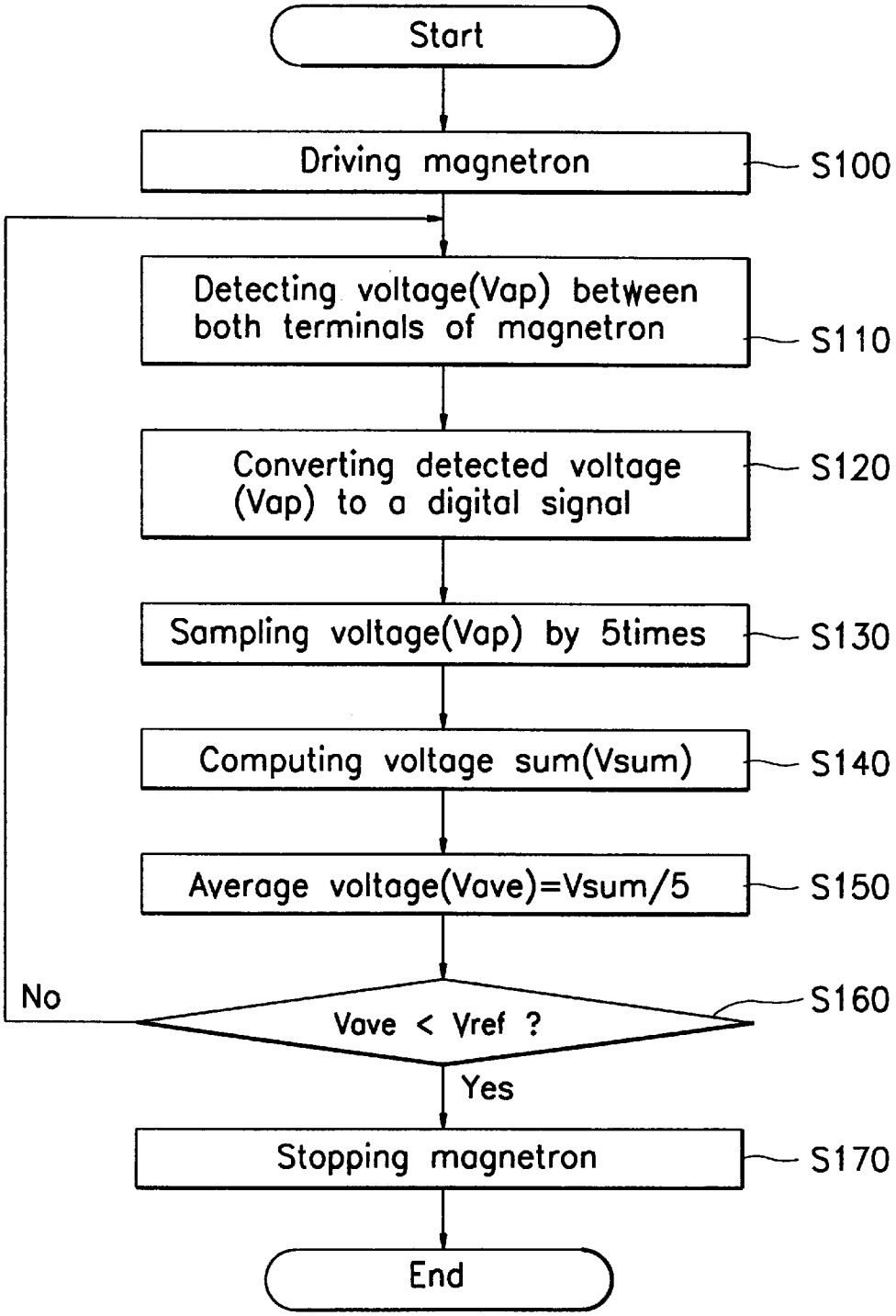
FIG. 4 depicts the control sequence of detecting an abnormal state of the microwave oven by checking the voltage applied to the magnetron's both terminals.

FIG. 4 is a control sequence of detecting an abnormal state of the microwave oven by checking the voltage between both terminals of the magnetron 30.

Once a user selects a cooking function through the key input part 40, the control part 50 closes the first relay RY21 to perform the user-selected cooking function, and applies the input AC power 1 to the high voltage part 20. The magnetron 30 is operated (S100) by the AC voltage rectified by this high voltage part 20.

Once the magnetron 30 is actuated, the voltage sensing part 60 detects (S110) the voltage Vap between both the terminals of the magnetron 30. The control part 50 receives the voltage Vap between both the terminals of the magnetron 30 from the voltage sensing part 60 through the A/D converting terminal, and converts (S120) it to a digital signal. The control part 50 samples the digitalized voltage Vap between both the terminals of the magnetron 30 by a predetermined number (e.g. five times), and detects (S130) five voltage values per period. After that, the control part 50 adds the five output voltage values to obtain (S140) a voltage sum (Vsum).

Subsequently, the control part 50 divides the voltage sum by five, the sampling number, thus computing (S150) an average voltage Vave of the voltage (Vap) of both the terminals of the magnetron 30. The control part 50 determines (S160) whether or not the average voltage Vave is lower than the reference voltage Vref.

If the control part 50 determines that the average voltage Vave is lower than the reference voltage Vref, it interprets that as an abnormal state of the microwave oven such as an unloaded state where nothing is in the cooking chamber, or an overheated state of the cooking chamber or magnetron to turn off the relays RY21 and RY22 so that the magnetron 30 stops operating (S170).

Figure 5:
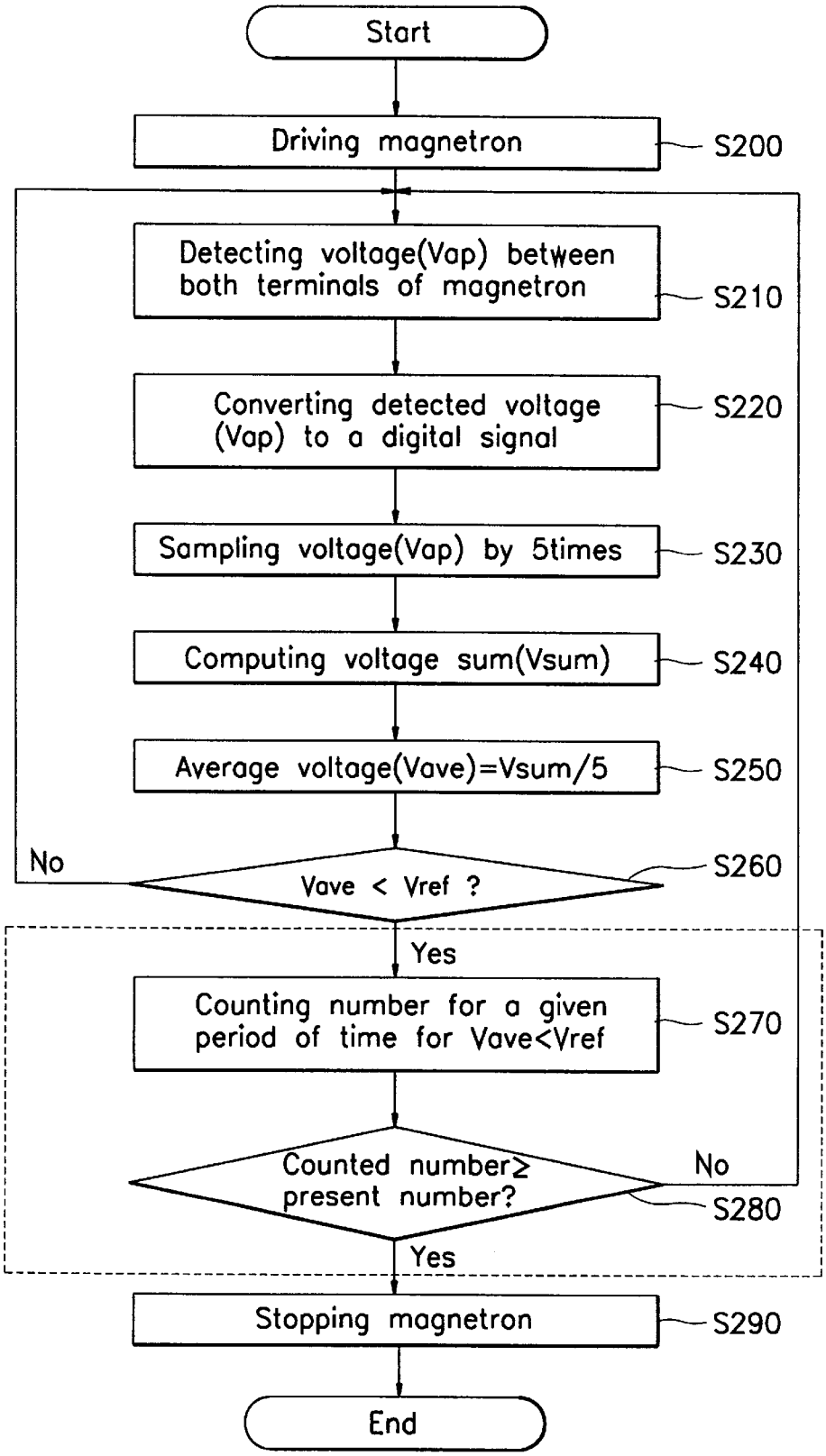
FIG. 5 depicts the control sequence of preventing an abnormal state that may occur due to the temporary erroneous operation by delaying stopping the magnetron's operation for a given period of time when determining that the microwave oven is in an abnormal state in accordance with the present invention.

FIG. 5 depicts the control sequence of preventing an abnormal state that may occur due to the temporary erroneous operation by delaying stopping the magnetron's operation for a given period of time even though the average voltage Vave is lower than the reference voltage Vref.

As shown in FIG. 5, as a user selects a cooking function through the key input part 40, the control part 50 applies the input AC power 1 to the high voltage part 20 by turning on the first relay RY21 to perform the user selected cooking function. The magnetron 30 is actuated by the voltage rectified by the high voltage part 20 (S200).

As the magnetron 30 goes into action, the voltage sensing part 60 detects (S210) the voltage Vap between both the terminals of the magnetron 30, and the control part 50 receives the voltage Vap between both the terminals of the magnetron 30 from the voltage sensing part 60 through the A/D converting terminal to convert that to a digital signal (S220). The control part 50 samples the voltage Vap between both the terminals of the magnetron 30 by a preset number (e.g. five times), and detects five voltage values per period (S230). The control part 50 adds the detected five voltage values to find (S240) a voltage sum (Vsum).

The control part 50 divides the voltage sum (Vsum) by five, the sampling number, to compute (S250) an average voltage (Vave) of the voltage Vap. The control part 50 monitors (S260) whether or not the average voltage Vave is lower than the reference voltage Vref to determine the present state of the microwave oven.

If the control part 50 determines that the average voltage Vave is lower than the reference voltage Vref and an abnormal state occurs, it computes an average voltage Vave, continuously receiving the voltage Vap between both terminals of the magnetron for a given period of time, and counts (S270) the number of the computed average voltage Vave's being lower than the reference voltage Vref. The control part 50 determines (S280) whether or not the counted number is larger than a given number (e.g. 10). When the control part 50 determines (S280) that the counted number is larger than the given number (e.g. 10), it interprets that as an actual abnormal state not a temporary abnormal state, and stops (S290) the operation of the magnetron 30 to complete the program.

The microwave oven abnormal state detecting method shown in FIG. 4 differs from FIG. 5's by the existence of FIG. 5's dotted line, and FIG. 4's method is similar to FIG. 5's as to the rest. As described above, the microwave oven abnormal state detecting device of the present invention does not contain any conventional overheat cutoff switch to lower the overall production costs, and stably detects an abnormal state such as an unloaded state of the cooking chamber or an overheated state of the cooking chamber or magnetron during cooking by the use of the voltage between both the terminals of the magnetron, thus preventing damage to the oven's internal components or various dangerous troubles that may occur when the abnormal state is left unsettled for a long period of time.

What is claimed is:

1. A device of detecting an abnormal state of a microwave oven having relays either applying or cutting off a power, a high voltage transformer receiving a voltage through the relays and increasing the voltage to a given level, and a magnetron driven by the voltage increased by the high voltage transformer and generating a high frequency to a cooking chamber, the device comprising:

a voltage sensing part connected between the high voltage transformer and the magnetron to sense a voltage applied to both terminals of the magnetron; and a control part receiving the sensed voltage between both the terminals of the magnetron from the voltage sensing part, determining an abnormal state when an unloaded state exists where nothing is in the cooking chamber or an overheated state of the magnetron or the cooking chamber exists, and when it is determined that the microwave oven is in the abnormal state, turning off the relays to stop the operation of the magnetron.

2. A device according to claim 1, wherein the voltage sensing part includes:

first and second resistors each connected to the magnetron's input terminal to detect the voltage between both the terminals of the magnetron and to drop the voltage in a given ratio;

a comparator comparing the voltage between both the terminals of the magnetron applied to an inverting terminal (−) with a reference voltage applied to a non-inverting terminal through a third resistor; and a fourth resistor and a zener diode each connected to the comparator's output terminal.

3. A device according to claim 1, wherein the control part stops the operation of the magnetron if an average value found by averaging the voltage between both the terminals of the magnetron for a given period of time is lower than the predetermined reference voltage.

4. A device according to claim 1, wherein if the average value found by averaging the voltage between both the terminals of the magnetron for a given period of time is lower than the predetermined reference voltage, the control part counts the number of the average which are lower than the reference voltage for a predetermined period of time, and delays stopping the magnetron.

5. A device according to claim 4, wherein if the number counted for a predetermined period of time is larger than a given number, the control part stops the operation of the magnetron.

6. A method of detecting an abnormal state of a microwave oven comprising the steps of:

driving a magnetron to perform a user-selected cooking operation;

detecting a voltage between both terminals of the magnetron;

computing an average voltage by averaging the voltage applied to both the terminals of the magnetron;

detecting an abnormal state by comparing the average voltage to a given reference voltage; and if it is detected that the microwave oven is in the abnormal state, stopping the operation of the magnetron.

7. A method according to claim 6, wherein the step of computing the average voltage comprises the substeps of:

converting the voltage between both the terminals of the magnetron to a digital signal;

sampling the digitalized voltage between both the terminals of the magnetron by a given number, and adding all the sampled values to find a voltage sum; and dividing the voltage sum by the given number to compute an average voltage.

8. A method according to claim 6, wherein in the step of detecting an abnormal state a case where the average voltage of the voltage applied to both the terminals of the magnetron is lower than the reference voltage, is interpreted as the abnormal state.

9. A method according to claim 6, wherein the step of detecting an abnormal state comprises the substeps of:

if the average voltage of the voltage applied to both the terminals of the magnetron is lower than the reference voltage, counting the number of the average which are lower than the reference voltage; and comparing the counted number to the given number to determine an abnormal state of the microwave oven.

10. A method of detecting an abnormal state of a microwave oven comprising the steps of:

driving a magnetron to perform a user-selected cooking operation;

detecting a voltage between both terminals of the magnetron;

converting the voltage between both the terminals of the magnetron to a digital signal;

computing an average voltage by averaging the voltage applied to both the terminals of the magnetron;

determining if the average voltage of the voltage applied to both the terminals of the magnetron is lower than the reference voltage; and if the average voltage is lower than the reference voltage, determining that the microwave oven is in an abnormal state, and stopping the operation of the magnetron.

* * * * *